US011623717B2

(12) United States Patent
Azriel et al.

(10) Patent No.: US 11,623,717 B2
(45) Date of Patent: Apr. 11, 2023

(54) EMERGENCY FLOTATION DEVICE WITH CHEMICAL REACTION CHAMBER

(71) Applicant: SEA-ARK TECHNOLOGIES LTD., Ra'Anana (IL)

(72) Inventors: Matityahu Azriel, Nehalim (IL); Oriya Shoham, Yakir (IL); Noam Hassidov, Bustan Hagalil (IL); Moshe Shoham, Hoshaya (IL)

(73) Assignee: SEA-ARK TECHNOLOGIES LTD., Ra'anana (IL)

( * ) Notice: Subject to any disclaimer, the term of this patent is extended or adjusted under 35 U.S.C. 154(b) by 62 days.

(21) Appl. No.: 16/767,606

(22) PCT Filed: Nov. 29, 2018

(86) PCT No.: PCT/IL2018/051314

§ 371 (c)(1),
(2) Date: May 28, 2020

(87) PCT Pub. No.: WO2019/106677

PCT Pub. Date: Jun. 6, 2019

(65) Prior Publication Data

US 2020/0407031 A1 Dec. 31, 2020

Related U.S. Application Data

(60) Provisional application No. 62/591,787, filed on Nov. 29, 2017.

(51) Int. Cl.
*B63C 9/19* (2006.01)
*B63C 9/105* (2006.01)
(Continued)

(52) U.S. Cl.
CPC ..... *B63C 9/19* (2013.01); *B63C 9/1055* (2013.01); *B63C 9/1255* (2013.01); *B63C 9/155* (2013.01)

(58) Field of Classification Search
CPC ..... B63C 9/1055
See application file for complete search history.

(56) References Cited

U.S. PATENT DOCUMENTS 1,240,686 A * 9/1917 Luca ..... B63C 9/18 441/101
4,781,645 A * 11/1988 Kato ..... A63H 33/00 446/221

(Continued)

*Primary Examiner* — Andrew Polay
(74) *Attorney, Agent, or Firm* — AlphaPatent Associates, Ltd; Daniel J. Swirsky

(57) ABSTRACT

An inflatable flotation device having a reaction chamber with reactants that generate gas when mixed, said reactants being separated by a barrier assembly; an activating mechanism adapted to remove or puncture the barrier assembly such that said reactants mix; and an inflatable compartment fluidly connected to the reaction chamber by means of a pressure sensitive passageway, adapted to open only when the pressure of the gas in said reaction chamber exceeds a predetermined threshold. This ensures that most of the reactants are used up to generate gas before the gas enters the inflatable chamber, thus preventing scattering of the reactants. Some implementations have a reaction chamber without a barrier assembly, comprising reactants that generate gas when mixed with water and an activating mechanism adapted to expose the reactants to water. A variety of manual or automatic mechanisms may be employed to activate the reaction and inflate the device.

17 Claims, 7 Drawing Sheets

(51) Int. Cl.
*B63C 9/125* (2006.01)
*B63C 9/15* (2006.01)

(56) References Cited

U.S. PATENT DOCUMENTS 5,941,752 A * 8/1999 Liebermann ..... B01J 7/02
441/98
2003/0236040 A1 * 12/2003 Miller ..... B63C 9/155
441/98

* cited by examiner

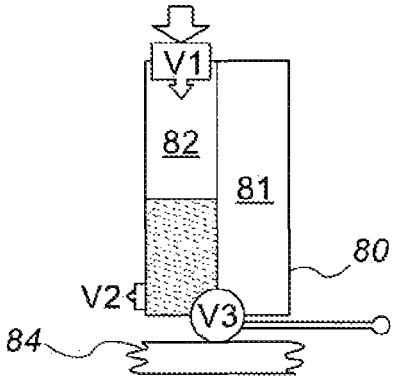
FIG. 8A
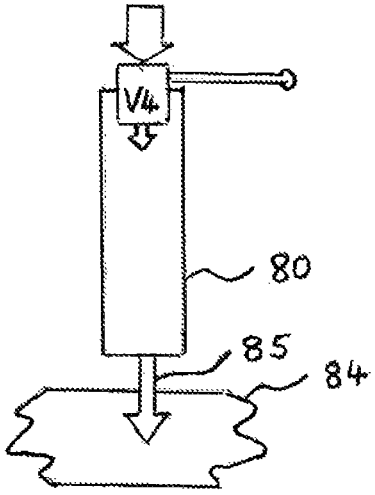
FIG. 8D
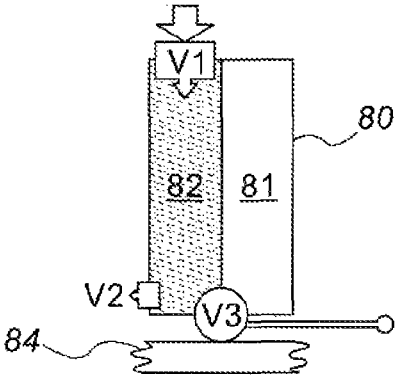
FIG. 8B
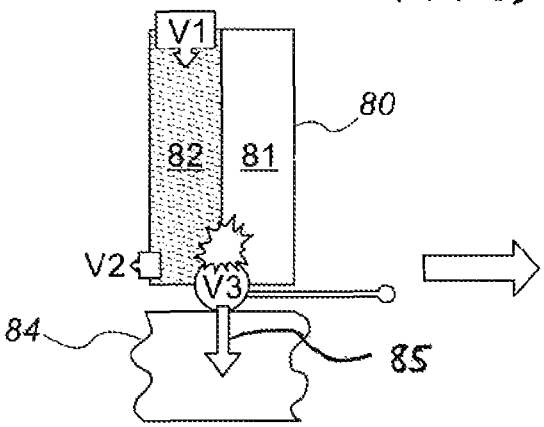
FIG. 8C
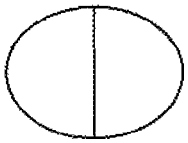
FIG. 9A
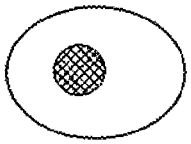
FIG. 9B
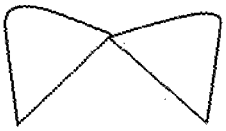
FIG. 9A.1
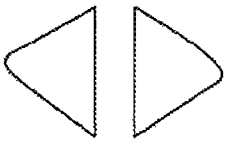
FIG. 9A.2

EMERGENCY FLOTATION DEVICE WITH CHEMICAL REACTION CHAMBER

CROSS-REFERENCE TO RELATED APPLICATIONS

This application is a U.S. National Phase Application under 35 U.S.C. 371 of International Application No. PCT/IL2018/051314, which has an international filing date of Nov. 29, 2018, and which claims priority and benefit from U.S. Provisional Patent Application No. 62/591,787, filed Nov. 29, 2017, the contents and disclosure of which are incorporated herein by reference in their entirety.

FIELD OF THE INVENTION

The present invention relates to the field of emergency flotation devices, especially for use in prevention of deaths due to drowning.

BACKGROUND

Drowning is a major cause of death worldwide, claiming the lives of more than 300,000 people every year. Many of the drowning events occur in natural waters such as the sea and lakes in the absence of a supervising life guard, and many would have been preventable with use of a personal flotation device.

The prior art describes bracelets, armbands, and other inflatable devices designed for emergency use. Some prior art describes devices that use release of a pressurized gas to inflate such devices. For example, DE 202012007732 to G. Schmelzer for "Rescue bracelet or water airbag for bathers or swimmers users are swimmers such as children, young people of all ages, adults, seniors" describes a bracelet having a capsule and a balloon. Upon activation, pressurized air from the capsule flows into the balloon causing it to inflate. Likewise, WO 2014/077728 to P. P. Mukhortov for "Life-saving wristband" describes a wristband having a system for filling an inflatable elastic buoyance chamber with a gas, such as from a compressed air vessel. DE 202005001471 to P. Tangermann for "Arm-worn marine or swimming pool survival floatation aid has hand-operated inflation trigger grip" describes an armband having a "container for an inflatable bladder" that is "linked to a gas cartridge and activation line" (EPO translation). Activation of this device allows compressed air from inside the gas cartridge to escape into the empty bag and inflate it. Such devices have the disadvantage that a cartridge or vessel of compressed gas needs to be sturdy enough to withstand the pressure of the gas, and hence is expected to be of additional weight and volume.

Other prior art devices use chemical reactions that produce gas to inflate the device. For example, U.S. Pat. No. 7,267,509 to W. H. Jackson III for "Floatation device" describes use of "different chemical reactions that can be used to produce a large amount of gas in a short period of time" such as adding an electrical impulse to sodium azide ($NaN_3$), or fracturing high pressure carbon nanotubes. CN 202670079 to H. Wang for "Bracelet-shaped water self-rescue device" describes a bracelet having "a main container 2 in which a liquid reactant 3 is stored, which is made of an elastic material; [and] a secondary container 7 in which a solid reactant 6 is stored." "The auxiliary container is communicated with the main container through a through hole" and activation via a pull ring allows the solid and liquid reactants to mix and create a gas. CN 103693180 to R. Jing for "Self-aid wristband convenient to carry" describes a self-aid wristband having "thin film spacers in the radial direction of the hand ring" which can be torn to activate generation of gas and inflation of the wristband.

In all of these prior art devices, the compartment or inflatable bladder has a dual function of storing one or more reactants and of becoming inflated with the gas product. This arrangement has a major disadvantage in that it may not allow full utilization of the reactants, or full completion of the chemical reaction, since some of the reactants may become dispersed by the gas during its generation and hence not used in generating further gas, or some of the reactants may become trapped in crevices within the bladder, or the reactants may be not be in close enough contact, such as positioned at opposite sides of a compartment, or the reactants may not completely mix. In addition to being a potentially inefficient system, it may also have a large amount of variation in the amount of gas produced because it is unpredictable what quantity of the reactants will be available for the chemical reaction. Another disadvantage of such a dual function arrangement is that it may present a higher risk in the event of a failure, such as a leak, since dangerous compounds, such as "highly reactive and potentially explosive" sodium described in U.S. Pat. No. 7,267,509, may be present in the bladder. Furthermore, in some of these chemical reactions described, additional energy input is needed in addition to the reactants and a simple activation mechanism, such as in the case of the electrical impulse described in U.S. Pat. No. 7,267,509, making the device more complex and also increasing risk. Finally, in some of the chemical reactions described, it may be necessary to add additional chemicals not needed for the production of gas, such as in U.S. Pat. No. 7,267,509 in which "other chemicals are added, such as silicon oxide, to react with the sodium to reduce it to a harmless material since sodium is highly reactive and potentially explosive." The addition of chemicals not needed in the production of gas increases the cost and complexity of the device, and makes the device more prone to failure.

In a life saving device, the efficiency, simplicity, consistency of performance, and fail-safe abilities of the device are critical, since a lack of gas produced or a malfunction may cost a person his life.

There therefore exists a need for a reliable and easy-to-use emergency floatation device, which overcomes at least some of the disadvantages of prior art systems and methods.

The disclosures of each of the publications mentioned in this section and in other sections of the specification, are hereby incorporated by reference, each in its entirety.

SUMMARY

The present disclosure describes new exemplary systems for emergency flotation devices, having a novel double-chamber structure, comprising a first chamber in which the chemical reaction takes place, and a second inflatable compartment. The use of a separate chamber in which the chemical reaction takes place, allows full or essentially full completion of the chemical reaction, without the reactants being allowed to disperse. Unlike the devices having a dual function compartment described in the prior art, in which both the reaction and inflation take place in the same compartment, the presently disclosed systems have a separate reaction chamber and a separate inflatable compartment, each of which is constructed to efficiently fulfill its own dedicated function. The gas-tight inflatable compartment is generally the outer compartment and the reaction chamber is generally disposed within the outer compartment, to contain and protect the reactants, increasing safety of the device. However, in alternative implementations, the reaction chamber may be provided on the outside of the device, peripheral to the inflatable compartment, preferably with concomitant safety measures in place to prevent leakage of the reactants out of the device.

The chemical reaction chamber, generally the inner compartment, is a closed volume in which the reagents are constrained from exiting the reaction chamber, thereby being kept in contact during the reaction, in order to allow the full completion, or essentially full completion of the reaction. This structure provides a maximum yield of gas from the reactants, allowing a smaller volume of reactants to be used, thus decreasing the size and increasing the convenience of the wearable device. In addition, since it is expected that there will be maximum yield from the chemical reaction, the device consistently produces the same amount of gas and the user may feel secure that there will be adequate gas output in the event of an emergency.

The extent of the term above—essentially full completion of the reaction—is dependent on the particular design and intended usage of the device. Optionally, the device should enable full completion of the reaction, such that maximum use is made of the reactants, and the maximum amount of inflation gas is generated. However, since the ideal of complete usage of the reactants will generally not be achievable, a compromise construction must be used to maximize the practical use of the reactants. Thus, if speed of deployment of the flotation device is the primary aim, then the outflow of a larger part of the reactant solution before the reaction has been completed can be tolerated. On the other hand, if minimum weight and compactness of the device is the primary aim, then more of the reactants should be contained within the reaction chamber before the exit passageway opens, to allow the maximum possible yield of inflation gas. Thus, the term "essentially full completion of the reaction" could be 95% of the reaction, or 90%, or 80% or only 70%, or even less, depending on the specific requirements of the device. The person of skill in the art will be able to design the flotation device to achieve the required specification in this respect, all of such designs relying on the common feature of maintaining the reactants in a reaction chamber separate from the inflation chamber until as much of the reactants as possible can be used to generate gas.

Essentially full completion of the reaction is enabled by use of a dedicated passageway between the reaction chamber and the inflatable compartment, which has a number of special properties which ensure the functionality of the device. There are two different approaches by which this can be achieved, with the device using either or both of the methods. The approach used, and hence the constructional features of the device, is dependent on the particular reactants used, or more particularly, on the speed with which the reaction takes place. In both of the approaches, the exit aperture from the reaction compartment to the inflation chamber is implemented as a pressure sensitive, one-way passage, such that it only opens in the preferred direction of opening, and only when the internal pressure within the reaction chamber has reached a predetermined level, causing the passageway to open. Under those circumstances, the passage from reaction chamber to the inflation chamber opens only when sufficient gas has been generated to increase the pressure sufficiently to open the passageway valve. According to the situation when the reactants and their physical form are such that the reaction takes place quickly, the gas is generated in a time which is short compared with the time taken for the reactant solution to leak out through the passageway from the reaction chamber, this minimizing any residual transfer of reactants before the reaction is in its advanced stages. Then it is sufficient that the passageway should be uni-directional and pressure sensitive. In such a case, gas may flow from the reaction chamber to the inflatable compartment, but essentially not back, only when a sufficient pressure has been generated in the reaction chamber. This minimizes any residual transfer of reactants before the reaction is in its advanced stages.

On the other hand, if the reaction is slow, such as for instance if it is necessary to dissolve solid components of the reactants in water before the action can commence, then the passageway should be such that there is significantly easier passage of the gas out of the reaction compartment, as compared with the liquid reactants, or as compared with the solution resulting from the addition of water to solid reactants. This ensures that the reactants are kept within the reaction chamber for as long as possible while the reaction is taking place, thus ensuring full completion of the reaction. The dedicated passageway may be described as providing substantially preferential passage of the gas over the liquid reactants. This means that while passageways in general naturally provide preference of the passage of gases over the passage of liquids, due to the molecular properties of these different phases and their respective viscosities, the passageways described in the present disclosure are constructed such that this effect is amplified above what a conventional orifice, slit or passage would provide.

The dedicated passageway may be, for example, an airway, a valve, or a membrane that allows gas to pass, without allowing any significant amount of the chemical compound solution to pass. The gas permeable membrane solution may be implemented by constructing the walls of the reaction chamber of that membrane material, thereby providing a sufficiently large transfer surface to enable the membrane to achieve its filtering function within a reasonable time scale.

One example of a passageway for use in such devices could be a uni-directional, pressure sensitive, duckbill valve positioned between the reaction chamber and inflatable compartment, such a valve having all of the above described special properties. Such a duckbill valve may be structured to only open at a predefined minimum pressure, which would only be achieved when the reaction is in the advanced stages, and at these stages there is virtually no remaining liquid reactant solution. In that respect, such a passageway would fulfill its function regardless of the speed of the reaction.

Relating now to the chemical reaction used to generate gas for inflation of the device, in one particularly advantageous implementation, use is made of an acid and a base that generate gas upon reacting, but other suitable gas generating reactants may be used. The reactants may be in solid form, such as crystals or powder, in which case saline or fresh water may be used as an additional component, which may conveniently be obtained from water surrounding the user while swimming. In other implementations, a desired amount of water may be provided in a designated chamber during manufacture of the device. Alternatively, an acid may be provided as an acidic solution, or a base may be provided as an alkaline solution, or both, such that the addition of water may not be necessary.

The inflatable component, generally the outer compartment, should be a sealed, gas-tight compartment designed to collect the gas produced from the chemical reaction occurring in the reaction chamber. When the inflatable compartment inflates, it allows the swimmer to be supported such that his head can remain above the water.

Activation of the device starts the chemical reaction by mixing the reactants. The gas produced from the chemical reaction then emerges from the reaction chamber to the inflatable compartment through the designated one-way, pressure sensitive passage. Since the reactants, some of which may be potentially harmful to human contact, are kept in the reaction chamber, generally in an inner protected chamber, and the inflatable chamber should contain only gas, the presently disclosed devices provide increased safety over prior art devices. For example, in the event of a leak in the outer wall of the inflation compartment of the device, only gas would be expelled, and there would not be a significant risk of human contact with potentially harmful chemicals or compounds, such as acid.

In a further advantageous implementation, the reaction chamber may be equipped with a one-way valve for bringing in a predetermined amount of water surrounding the user, such as sea water, to be used in the gas producing chemical reaction. This minimizes the amount of acid and base reactant needed, allowing the device to be light-weight. The reactants may be provided in solid form, and the entire volume of water needed for the reaction may be provided from water surrounding the user in this manner. Alternatively, the acid may be provided as a concentrated acidic solution, and a base may be provided as a concentrated alkaline solution, or vice versa, and then water may be drawn in to the device while the user is swimming to dilute either or both of the solutions.

The presently disclosed devices are designed to be light-weight and their structure is configured so that it does not interfere with swimming motion prior to activation. Such devices may be conveniently and quickly activated by a user with a manual trigger, such as a handle, a cord, or a similar device. Alternatively, they may be activated by an automatic sensor, such as a depth sensor or a pressure sensor, to initiate the chemical reaction and inflation. Such automatic activation may use electric or ultrasound sensors, and may comprise a time delay feature to differentiate between swimming and drowning, such that the device only becomes activated when the sensor is below water level for a predetermined time duration. Generally, the implementations comprising automatic sensors also comprise a manual activation option for increased safety.

The presently disclosed flotation devices are wearable or easily portable, light-weight, disposable, inflatable devices designed for use in emergencies to prevent drowning by supporting the user such that the user may float with his head above the water level.

There is therefore provided, in accordance with an exemplary implementation of the devices described in this disclosure, an inflatable flotation device comprising:

(i) a reaction chamber comprising reactants that generate gas when mixed, the reactants being separated by a barrier assembly, (ii) an activating mechanism adapted to either remove or to puncture the barrier assembly such that the reactants mix, and (iii) an inflatable compartment fluidly connected to the reaction chamber by means of at least one pressure sensitive passageway, adapted to open only when the pressure of the gas in the reaction chamber exceeds a predetermined threshold.

In such an inflatable flotation the predetermined threshold may be selected such that the reaction between the reactants is essentially complete before the at least one pressure sensitive passageway opens, such that the reactants are kept within the reaction chamber until the reaction is essentially complete. The at least one passageway may further be adapted to provide substantially preferential passage of the gas over the reactants, such that the reactants are generally contained within the reaction chamber until the reaction is essentially complete. The at least one passageway may most conveniently be a valve, and should be one directional towards the inflation chamber. Alternatively, the at least one passageway may be a semi-permeable membrane preferentially enabling passage of gases over liquids. In any event, the at least one passageway should be sufficiently small that it allows substantially preferential passage of the gas over the reactants.

In further exemplary implementations of the inflatable flotation devices of the present disclosure, the reactants may comprise an acid or acidic solution and a base or alkaline solution, and optionally, water. Additionally, at least one reactant may be in a non-aqueous state. Furthermore, the reactants may comprise a volume of less than 80 milliliters and generate at least 5 liters of gas.

In yet other implementations, the barrier assembly may be a sheet and the activating mechanism a pointed element adapted to puncture the sheet. The activation mechanism may comprise a manual trigger, and that manual trigger may be at least one cord attached to the barrier assembly. Additionally, the barrier assembly may be comprised of a decomposable material that disintegrates or dissolves when exposed to the gas.

Even more implementations of the inflatable flotation device may further comprise a sensor indicative of immersion in water for more than a predetermined time, and providing a signal to activate the inflation device.

Finally, for any of the above described implementations, the barrier assembly may comprise at least one of a removable cap, a removable layer, a blister pack, a tube and a clamp.

There is further provided according to yet another implementation of the inflatable flotation devices of the disclosure, an inflatable flotation device comprising:

(i) a reaction chamber comprising reactants that generate gas when mixed with water, (ii) an activating mechanism adapted to expose the reactants to water, and (iii) an inflatable compartment fluidly connected to the reaction chamber by means of at least one pressure sensitive passageway, adapted to open only when the pressure of the gas in the reaction chamber exceeds a predetermined threshold.

Such an inflatable flotation device may further comprise a water inlet valve connecting the reaction chamber to the ambient water environment of the device, such that the reaction chamber can be filled from ambient water surrounding the device when the water inlet valve is open. Such a device may further comprise a separate compartment of the reaction chamber, the activating mechanism being adapted to expose said reactants to water by enabling water disposed in said separate compartment to mix with said reactants in said reaction chamber. Additionally, the device may further comprise a water inlet valve connecting the separate compartment to the ambient water environment of the device, such that the separate compartment of the reaction chamber can be filled from ambient water surrounding the device when the water inlet valve is open.

In any of the above described inflatable flotation devices, the predetermined threshold may be selected such that the reaction between the reactants when mixed with water is essentially complete before the at least one pressure sensitive passageway opens, such that the reactants are kept within the reaction chamber until the reaction is essentially complete. The at least one pressure sensitive passageway may further be adapted to provide substantially preferential passage of the gas over the reactants, such that the reactants are generally contained within the reaction chamber until the reaction is essentially complete. Additionally, such inflatable flotation devices may further comprise a passageway between the separate compartment of the reaction chamber and the section of the reaction chamber containing the reactants, wherein the activating method opens the passageway such that the water can mix with the reactants. Furthermore, in any of these implementations, the water inlet valve may be actuated by the actuating mechanism.

According to yet another implementation, in these inflatable flotation devices, the separate compartment may further comprise a water outlet valve, such that the separate compartment can be emptied of water.

Additionally, these devices may further comprise a sensor indicative of immersion in water for more than a predetermined time, and providing a signal to activate the inflation device. In such a case, the sensor may be adapted to detect any one of vibration, depth, pressure or light.

Finally, in any of these implementations, the reactants may be solids.

BRIEF DESCRIPTION OF THE DRAWINGS

The present invention will be understood and appreciated more fully from the following detailed description, taken in conjunction with the drawings in which:

FIGS. 8A to 8D are schematic drawings that show a method of using another exemplary device of the present disclosure to fill the inner compartment with water and activate the device; and FIGS. 9A and 9B show two exemplary alternative closed capsules containing reactant to be housed within the reaction chamber of the flotation device, and FIGS. 9A.1 and 9A.2 show two alternative structures of the capsule of 9A after activation of the flotation device.

DETAILED DESCRIPTION

Figure 1A:
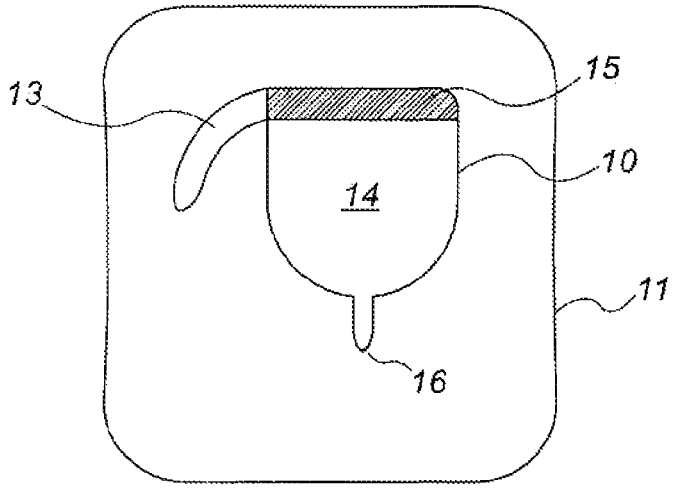
FIGS. 1A and 1B show conceptual cross sections of an exemplary flotation device of the present disclosure, having an inner reaction chamber and outer inflatable compartment, before and after activation respectively.
Figure 1B:
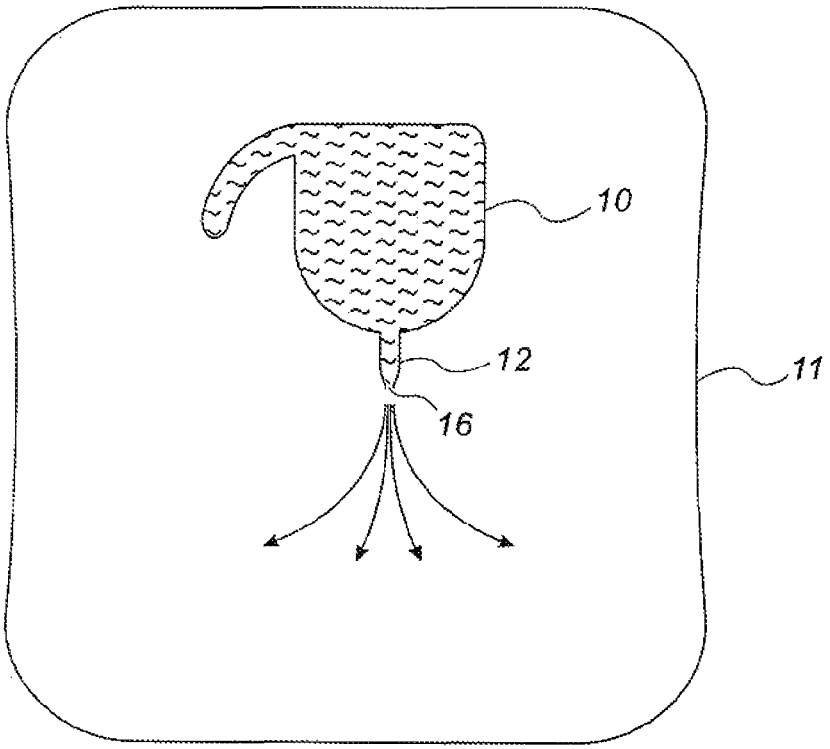

Reference is first made to FIGS. 1A and 1B, which show conceptually, schematic cross sections of an exemplary flotation device of the present disclosure, before and after activation respectively. The exemplary device has an inner reaction chamber 10 and an outer inflatable compartment 11 surrounding the reaction chamber, which are connected by a passageway 16. The device may be incorporated into an article of clothing or a dedicated belt or backpack or arm-sleeves which would be worn by the user, to provide conveniently wearable devices, such that deployment, when required, will be simple and accessible.

As shown in FIG. 1A, the inner reaction chamber is divided into two sections 13 and 14, each holding a different chemical compound that are capable of generating gas when mixed. One compound may be an acidic material (for instance, phosphoric acid —$H_3PO_4$, hydrochloric acid —HCl, citric acid —$C_6H_8O_7$ or others), with the other a basic material, i.e., having a pH above 7.0 (for example, sodium hydrogen carbonate —$NaHCO_3$). Prior to activation, the reactants 13 and 14 are separated by a removable or modifiable barrier. When the device is activated, which may be performed by pulling off separator 15, or by various alternative mechanisms of removing or modifying the barrier as will be discussed further herein below, the chemical compounds 13 and 14 are mixed in the reaction chamber 10, causing a chemical reaction that creates a gas, for instance, carbon dioxide when using a bi-carbonate base. During the reaction phase, both chemical compounds are essentially prevented from exiting the reaction chamber 10 and are kept in contact, rather than being allowed to disperse into the inflatable compartment 11, in order to allow close to full completion of the reaction. The chemical reaction between the two reactants 13 and 14 in the inner reaction chamber 10 thus occurs efficiently and in the shortest time possible.

As shown in FIG. 1B, the gas produced from the reaction emerges through a designated passageway 16 from the reaction chamber 10 to the outer compartment 11. Such a passageway may be a valve or a thin "tail". Alternatively, gas may emerge through a semi-permeable membrane permitting only gas through, but preventing any of the chemical compound solution to pass. This membrane implementation may be most easily implemented by constructing the reaction chamber walls of such a membrane material. In another alternative implementation, a duckbill valve is used to separate between the inner and outer compartments, as will be described in accordance with FIGS. 6A to 6H.

For a typical adult sized inflation chamber, the current device may hold approximately 75 ml of acid, base, and water which should allow the creation of 5 to 7 liters of gas. The corresponding weight of about 75 g can easily be carried by most swimmers, yet provides a sufficient amount of gas for adequate inflation capabilities in the event of need.

The inflatable chamber 11, generally the outer compartment, is sealed and designed to contain the gas originating from the chemical reaction occurring in the inner device. When the inflatable compartment inflates, it supports the swimmer such that his head can remain above water. It is to be understood that the term "inflatable chamber" may be a single component or may comprise multiple fluidly connected sections for increased comfort such as is typical in wearable flotation devices. However, in such a case of a device having multiple sections, it is to be understood that these sections are configured to be inflated with gas and that none of these sections comprise any reactants, nor does the chemical reaction occur in any of these sections.

Figure 2A:
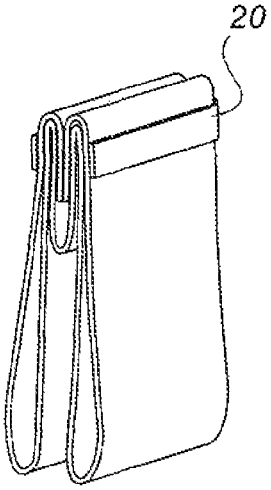
FIGS. 2A, 2B, and 2C show an isometric view of an exemplary flotation device of the present disclosure before, during, and after inflation respectively.
Figure 2B:
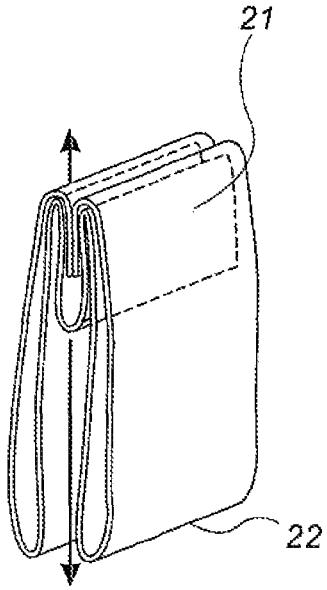
Figure 2C:
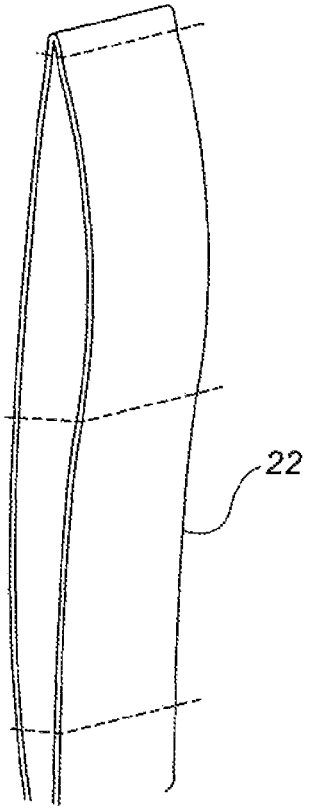

Reference is now made to FIGS. 2A to 2C which show isometric, schematic views of an exemplary flotation device before, during, and after inflation respectively. As shown in FIGS. 2A and 2B, the inner compartment 21 is folded within the outer compartment 22. A closure seal 20 separates the different reactants within the inner reaction chamber. Once the closure seal 20 is removed, as shown in FIG. 2B, the reactants may mix, generating the gas which inflates the device, allowing it to unfold as shown in FIG. 2C.

Figure 3A:
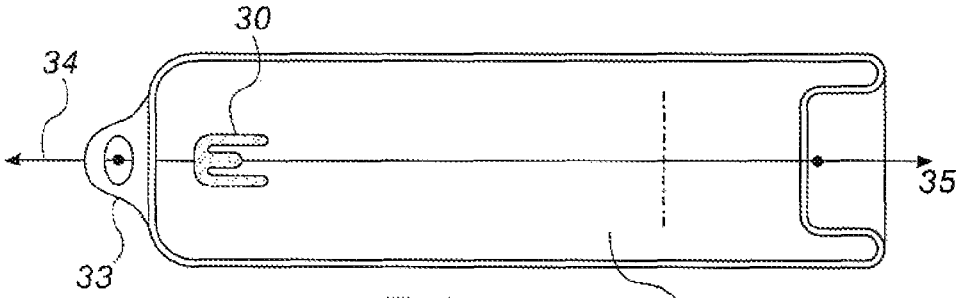
FIGS. 3A and 3B show an exemplary lateral cross sectional view of an alternative implementation of the disclosed flotation device before and after activation respectively.
Figure 3B:
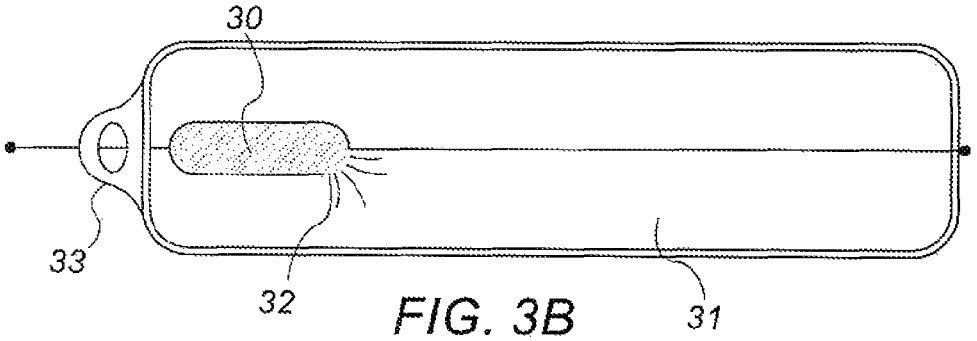

Reference is now made to FIGS. 3A and 3B which show lateral cross-sectional views of another exemplary flotation device before and after activation, respectively. As shown in FIG. 3A, the inner reaction chamber 30 has a compact form prior to activation and is contained within the outer inflatable compartment 31. The inner reaction chamber 30 houses the gas producing reactants, with each of the reactants being separated from each other by one or more barriers (not shown). The flotation device may be activated manually by pulling cords 34 and 35 in opposite directions simultaneously, as shown by the two directional arrows in FIG. 3A. This action removes the barriers and causes the chemical reaction between the reactants to commence. As a result of the sequence of manual activation and the chemical reaction, the inner reaction chamber achieves an expanded form, as shown in FIG. 3B. The gas created from the chemical reaction escapes through the passageway 32 into the outer inflatable compartment 31, inflating the device. The passageway 32 may be a one-way passageway that provides substantially preferential passage of the gas over the reactants, and should be pressure sensitive. Such a passageway may be, inter alia, a duckbill valve, a semi-permeable membrane or a "tail". The device may further comprise a handle 33 for the user to grip to support himself more easily, and to prevent the device from floating away from the user, in those cases where the device is not incorporated into an article worn by the swimmer. The details of the inner reaction chamber structure and alternative activation mechanisms are shown in exemplary FIGS. 4A to 4C below.

Figure 4A:
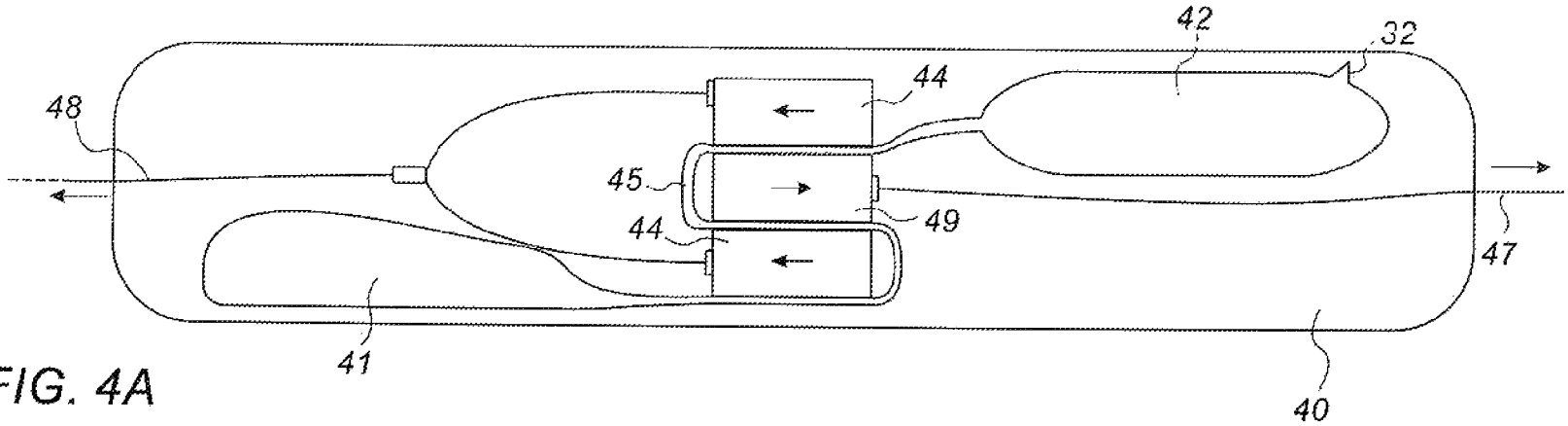
FIGS. 4A, 4B and 4C show exemplary details of alternative reaction chambers and activation mechanisms of the device of FIGS. 3A and 3B.
Figure 4B:
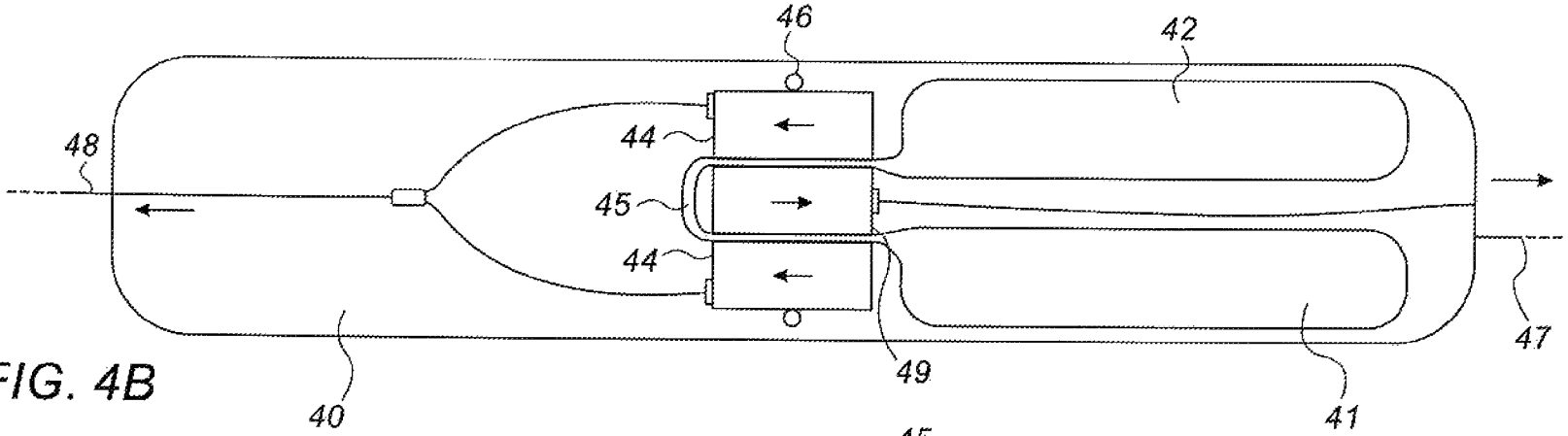
Figure 4C:
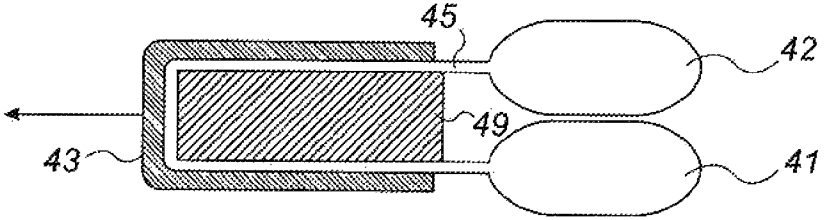

Reference is now made to FIGS. 4A to 4B which show exemplary alternative cross-sections of the flotation device shown in FIGS. 3A and 3B, having different reaction chamber structures. FIG. 4C shows an alternative implementation having yet another reaction chamber structure and activation mechanism.

Reference is first made to FIG. 4A, which shows the flotation device prior to activation. The reaction chamber is housed inside the outer inflatable chamber 40 and comprises two compartments 41 and 42 positioned at opposite ends of the inflatable chamber, each housing a different reactant. For example, compartment 41 may house an acid and compartment 42 may house a base. The compartments are connected by a flexible walled tube 45 which is clamped such that the reactants cannot mix, but are able to mix when the tube clamp is removed and the tube can expand. Clamping structures 44 and 49, apply pressure to compress the tube 45 prior to activation of the device, to a sufficient degree to prevent mixing of the reactants. The manual activation cords 47 and 48 are each connected to the clamping structures 44 and 49, and may be pulled in opposite directions simultaneously as shown by the arrows in FIG. 4A. This action pulls the clamping mechanisms 44 and 49 away from the collapsible tube 45, allowing the tube to expand and straighten. Once the compartments 41 and 42 are fluidly connected, the reactants may mix and the gas producing chemical reaction begins. The produced gas then flows through a passageway, shown in FIG. 4A as a spout 32, into the inflatable compartment 40, inflating the device. The mixing tube 45 and the spout 32 should be of dimensions commensurate with the flow required of the fluids within.

Reference is made to FIG. 4B which shows an alternative implementation of the reaction chamber. In this implementation, the reaction chambers 41 and 42 are positioned on the same side of the inflatable chamber, and the compressed flexible tube 45 makes a single U-turn around the clamping elements 44 and 49. An additional clamping element 46, may be used if the two elements 44 are separate pieces, instead of a U-clamp around both top and bottom of the element 49. The device is activated in the same manner as that of FIG. 4A. However, in this alternative reaction chamber structure, a further alternative construction feature is shown, in that the walls of compartments 41 and 42 are made of a gas permeable membrane that does not allow liquid reactants to pass through. The gas produced from the reaction passes through the membrane and into the outer inflatable chamber 40, inflating the device, while the liquid reactants are kept within the reaction compartments 41, 42.

Reference is made to FIG. 4C which shows yet a further exemplary implementation, in which the compressed connection tube 45 is simply clamped onto the central clamp block 49 by an external U-element 43, which, when pulled off the central block 49, enables the reactants to mix.

FIGS. 4A to 4C represent only three possible examples of how the reactant chambers are held separately and how the reaction activation takes place, but are not meant to limit the invention, and it is understood that many other configurations can be devised.

Figure 5A:
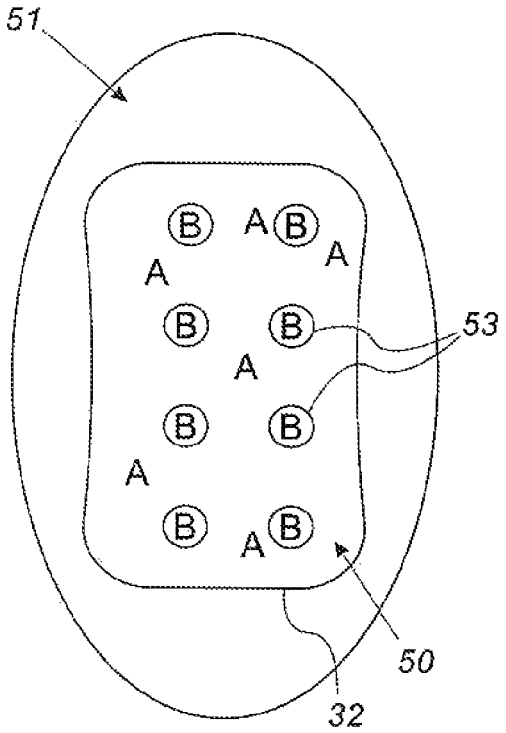
FIG. 5A shows a schematic cross sectional view of another exemplary implementation of the disclosed flotation device.
Figure 5B:
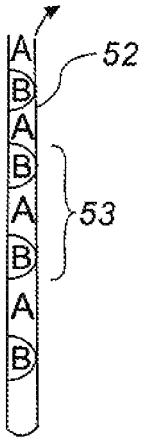
FIGS. 5B and 5C show a detailed close up of the inner reaction chamber of the device of 5A before and during activation.
Figure 5C:
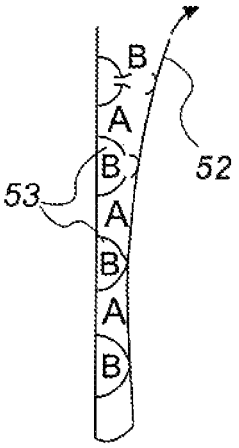

Reference is now made to FIGS. 5A to 5C which illustrate schematically an alternative construction for the devices of this application, using structures similar to blister packs of pharmaceuticals to keep the reactants separate. FIG. 5A shows a cross sectional schematic view of the complete flotation device, and FIGS. 5B and 5C show a detailed close up of the inner reaction chamber of the device before and during activation respectively. Reference is made to FIG. 5A, which shows the inner reaction chamber 50 housed within the outer inflatable compartment 51. A plurality of blisters 53, or alternatively elongated blister-like tubes, are spaced throughout the reaction chamber 50 that comprise a reactant compound B, for example a base. Another reactant, compound A, for example an acid, is stored in the spaces between the blisters or tubes 53. In the simplest implementation, either reactant A or B is an aqueous solution. Alternatively or additionally, water may be provided for the reaction through a one-way valve as will be shown in FIGS. 8A to 8C. Reactants A and B are gas producing reactants; however, the blisters 53 are not permeable to compound A, such that the compounds are not mixed prior to activation of the device.

Reference is made to FIG. 5B, which shows a detail of the reaction chamber 50 prior to activation. A removable layer 52 is positioned such that it is in contact with the top of the blisters 53, sealing the blisters and preventing compound B from exiting the blisters.

Reference is made to FIG. 5C, which shows how the device is activated by pulling off the removable layer 52 covering the blisters or tubes containing compound B. The layer may be pulled off by manually by the user, such as pulling a cord attached to the layer. This action removes a portion of the surfaces of the blisters 53 and allows compound B to exit the blisters, hence exposing compound B to the surrounding compound A. This exposure commences the gas producing reaction, and the gas exits the inner reaction chamber through a passageway 32, such as a valve, or through the membrane walls, inflating the outer compartment 51 with gas.

Figure 5D:
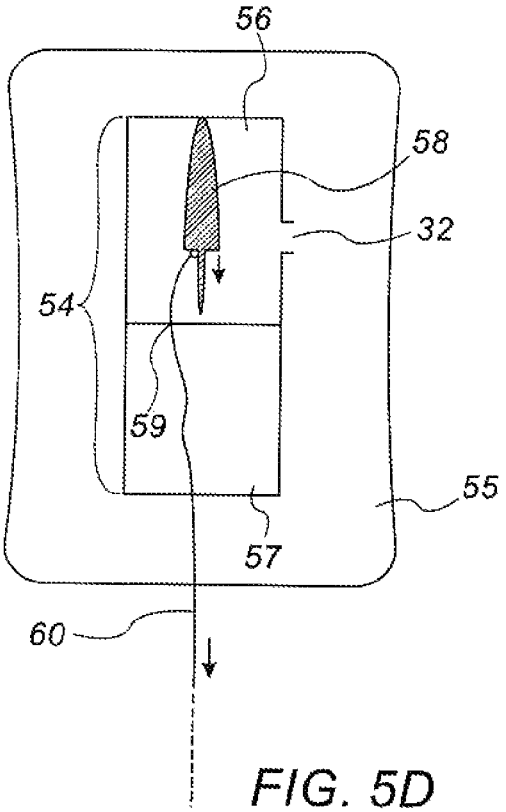
FIG. 5D is a schematic drawing of an alternative implementation of the presently disclosed device having a pointed element within the reaction chamber.

Reference is made to FIG. 5D, which shows an alternative exemplary reaction chamber structure. The reaction chamber 54 is divided into two separate sub-compartments 56 and 57 by means of a dividing sheet of a material 59 that can be readily punctured or slit. The first compartment 56, incorporates a pointed element 58, whose tip is directed towards the dividing sheet. On the other side of the dividing sheet, there is a second sub-compartment 57. The two reagents for generating the inflation gas are contained in the two separate sub-compartments on either side of the dividing sheet 59. Activation of the device causes the pointed element 58 to penetrate the dividing sheet, thereby enabling the reactants to mix and to generate the inflation gas. Either or both of the sub-compartments may have a passageway 32 that is configured to allow the passage of produced gas into the outer inflatable compartment 55.

In this implementation, the device may be activated manually, such as by pulling a cord 60, which may be attached to the pointed element 58, or to a structural part of the reaction chamber to which the pointed element is attached. One of the sub-compartments may contain a liquid reactant, such as an acidic solution, and the other may contain a solid or aqueous solution of the second reactant, which in this example would be a gas producing base.

Figure 6A:
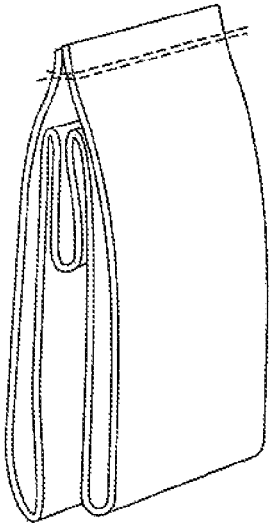
FIGS. 6A to 6H show a duckbill valve as an exemplary structure for the passageway connecting the reaction chamber to the inflatable compartment, such a structure being compatible with all of the disclosed implementations of the flotation device.

Reference is now made to FIGS. 6A to 6H, which show exemplary configurations of the passageway 32 of any of the above described implementations. As described above, the passageway should have special properties, including being pressure sensitive, and optionally also being uni-directional and providing substantially preferential passage of gas over reactants, to prevent the reactants from exiting the reaction chamber before the reaction is in the advanced stages. FIG. 6A shows the implementation of FIG. 2B again, with the passageway (not visible in the drawing) situated within the fold of the walls of the device before deployment. although the passageway may be located anywhere between the reaction chamber and the inflatable compartment.

Figure 6B:
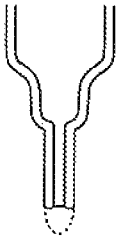
Figure 6C:
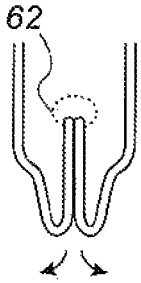
Figure 6D:
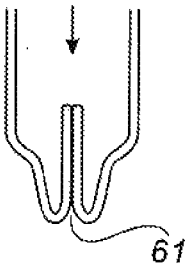

Reference is made to FIG. 6B which shows an exemplary "tail" which effectively acts as the passageway. Another exemplary configuration of the passageway is shown in FIGS. 6C and 6D. FIG. 6D shows a pressure sensitive passageway 61 prior to opening, and FIG. 6C shows the passageway 62 after activation of the device. As gas flows downwards toward the opening 61, pressure acts on the top of the valve 62, causing the valve 61 to open and allowing gas to flow from the inner reaction chamber to the outer inflatable chamber.

Figure 6E:
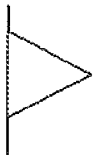
Figure 6F:
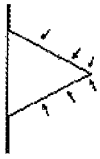
Figure 6G:
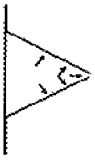
Figure 6H:
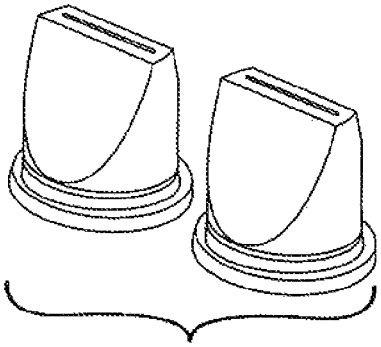

Reference is now made to FIGS. 6E to 6G which show an especially advantageous implementation having a pressure sensitive duckbill valve located between the reaction chamber and the inflatable chamber (not shown). As shown in FIG. 6E, when the device is not activated, the duckbill valve is closed and does not allow passage of reactants into the outer inflatable compartment. FIG. 6F shows how external pressure keeps the duckbill valve closed. FIG. 6G shows how the duckbill valve opens under the influence of internal pressure. As gas is created within the reaction chamber, this creates internal pressure on the duckbill valve and when this pressure reaches a predetermined level, the valve opens. The valve may be structured to open at a designated pressure that can only be achieved when the reaction is in the final stages, so as to avoid any significant leakage of reactants into the inflatable chamber prior to virtual completion of the reaction. FIG. 6H shows isometric views of exemplary duckbill valves.

Figure 7A:
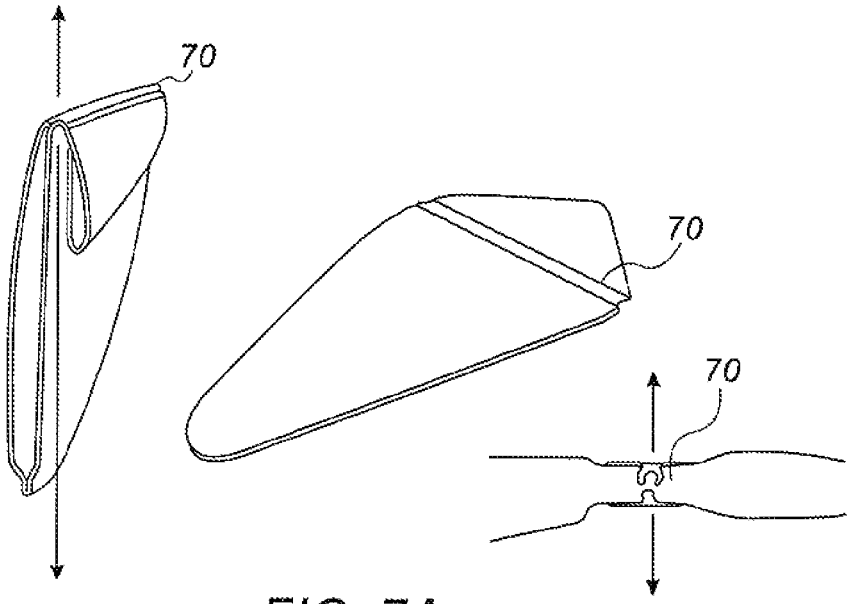
FIGS. 7A, 7B and 7C show further alternative implementations of the presently disclosed flotation device having alternative expandable structures and activation mechanisms.
Figure 7B:
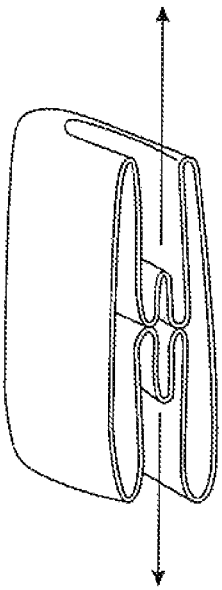
Figure 7C:
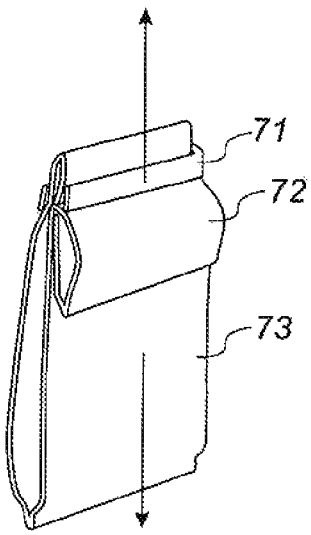

Reference is now made to FIGS. 7A to 7C, which show alternative structures of the flotation device and their respective activation mechanisms. Reference is made to FIG. 7A, showing a flexible locking seal 70 separating the compartments housing the different reactants. When the device is activated, the seal opens and the device unfolds as shown by the directional arrows. FIG. 7B shows an alternative structure of the device prior to activation, and the directional arrows show how the device unfolds upon activation. FIG. 7C shows an alternative configuration of the device having the reaction chamber 72 located on the outside of the device, and the inflatable reaction chamber 73 on the inside. The device may be activated by removing the closure seal 71, resulting in a chemical reaction and inflation of the device. The device is unfolded according to the directional arrows shown.

FIGS. 8A, 8B and 8C schematically show an alternative implementation of the device, in which the reactants are carried in solid form or as highly concentrated fluids and the water for enabling the reaction is drawn from the user's surroundings. The device can then be significantly smaller and lighter than the previous embodiments in which an aqueous solution of either the acid or base needs to be carried. Consequently, the device can be worn for example on the wrist similar to wristwatch or as a belt around the waist, causing negligible interference to the swimmer. Furthermore, at least in the case of both reactants being in solid form, since no reaction can take place in the absence of water, the two reactants can be mixed in a single chamber, thereby simplifying the device. This implementation has a one-way valve for drawing in water from the user's surroundings, for use in the chemical reaction that creates the gas. Any type of water, including fresh water or sea water, may be used.

Reference is now made to FIG. 8A, which shows a schematic representation of the device prior to activation. The reaction chamber 80 may be made up of two separate compartments, 81, 82. Compartment 81 may be a sealed dry storage container that houses both solid reactants, and compartment 82 is configured to collect a predetermined amount of water that is drawn in through a one-way valve V1 as the user is swimming. The collection of water is shown by the directional arrow in FIG. 8A. The water level is shown by the hatched area at the bottom half of the compartment. The function of an optional valve V2 is described hereinbelow. Valve V3 is situated between compartments 81 and 82. An empty plastic bag 84 is provided to contain the gas produced as described herein below.

Reference is now made to FIG. 8B, which shows compartment 82 full with the desired amount of water needed for the reaction, ready to be mixed with the dry reactants in compartment 81 to generate the flotation gas.

Reference is now made to FIG. 8C, which shows how the chemical reaction is activated by the user. By pulling the activation handle, valve V3 between the compartments 81 and 82 is opened, and the water charge in compartment 82 is allowed to mix with the dry reactants in compartment 81. The mixing of the water with the solid reactants enables the chemical reaction which generates the inflation gas, which flows through a pressure sensitive, one-way valve of the type described in the previous embodiments, indicated in FIG. 8C by the arrow 85 between the reaction chamber 80, and a plastic inflation bag 84, thereby filling the bag 84 with the flotation gas, while the reaction is constrained within the reaction chamber 80.

There are a two possible implementations of the device, depending on how it is intended to be used. According to a first, and probably more convenient implementation, the activation trigger causes two separate actions to occur. Valve V1, which enables entry of the sea or fresh water into the water container 82, is opened, thereby charging the reaction chamber with water, and at the same time valve V3 is opened, thereby allowing the water charge to mix with the dry reactants and to generate the inflation gas. This implementation has the advantage that until activated, the device does not contain any water, thereby contributing to its lightweight and convenient form.

According to a second implementation, the water entry valve V1, is activated by the user as soon as he/she enters the water, such that the water charge is ready for use in case of an emergency. Activation then only involves opening valve V3 to allow the pre-charged water to mix with the dry reactants and to generate the inflation gas. This implementation, though less convenient, since the swimmer has to wear the device with its water charge, even though that charge is only on the order of 75 g, has the advantage that the water charge can be collected at a time when no emergency is being experienced, such as when entering the sea to swim. In that case, the user has sufficient presence of mind to ensure that the water intake opening is below the water level of the sea. This may not be so certain with the previous first implementation, where water intake is only performed when the activation mechanism is triggered at the time of an emergency. An optional additional valve V2 may be located on compartment 82 for draining the water charge from the device when the user has finished swimming. Therefore, if the reaction has not been activated, draining of the water charge from the device through valve V2, enables the device to be dried out and used again.

Reference is now made to FIG. 8D, which shows a schematic drawing of an alternative structure for the devices of FIGS. 8A to 8C, in which only a single reaction chamber 80 is used, with both of the solid reaction components stored therein, and in which the reaction is instigated by actuation of a single valve V4, which enables entry of water from the outside when the activation mechanism is triggered at the time of an emergency. Once the gaseous products of the reaction are generated, they flow into the plastic inflation bag 84 through a one-way valve, as in the previously described implementations. The advantages of this device is that the construction is simpler, having only a single chamber, 80, and a single actuation valve V4, together with the one-way valve for inflating the flotation bag 84, and that the device is compact and light since it does not need to carry any water. The disadvantage of this embodiment, is that after actuation of the emergency trigger, the swimmer must wait while the reaction chamber fills with water for the gaseous flotation fill to be generated for passage to the flotation bag 84.

Reference is made to FIGS. 9A and 9B, which show two alternative closed exemplary capsules containing reactant that may be located inside the reaction chamber, and FIGS. 9A.1 and 9A.2 show two alternative structures of the capsule of 9A after activation of the device. The capsule of FIG. 9A is an acid-resistant plastic capsule containing a base in solid form, such as a powder, and having a score-line for opening. When the device is activated, the capsule may open along the score-line to achieve the structure shown in FIG. 9A.1, in which the halves of the capsule are still connected, or to the structure shown in FIG. 9A.2, in which the halves of the capsule are completely disconnected. When the capsule is open, the base within the capsule may come into contact with an acid in the reaction chamber around the capsule, causing a gas producing reaction. FIG. 9B shows an alternative capsule structure containing a solid base and having surface pores covered with polymer that react with acid, water, or both. When the device is activated, acid or water comes into contact with the polymer, and the polymer dissolves, causing the pores to be exposed and allowing the acid and base to react. Once the reaction has taken place, the inflation gas generated within the reaction chamber can pass through a pressure sensitive valve, of any of the types previously described, and to fill the inflation chamber, as in the previously described devices.

In any of these implementations, a depth sensor or pressure sensor (e.g., an ultrasonic sensor) may be connected to the inflation device, such that when the sensor reaches a predefined depth, it automatically activates the inflation device. This enables automatic activation of the device if the swimmer sinks into the water. Alternatively or additionally, any suitable simple manual activation mechanism, such as a lanyard, a handle, a lever, or tearing a seal, may be used to initiate a chemical reaction, thus activating the device.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

We claim:

1. An inflatable flotation device comprising:

a reaction chamber comprising one or more reactants that generate gas when mixed with water;

a water inlet valve connecting the reaction chamber to an ambient water environment surrounding the device such that the ambient water surrounding the device fills the reaction chamber when the water inlet valve is open;

a sensor indicative of immersion in water for more than a predetermined time, and providing a signal to activate the inflation flotation device; and an inflatable compartment fluidly connected to said reaction chamber by means of at least one pressure sensitive passageway comprising a one-way valve, a semi-permeable membrane or a tail adapted to enable unidirectional gas flow towards the inflatable compartment when the pressure of the gas in the reaction chamber exceeds a predetermined threshold, wherein the predetermined threshold, at which the passageway opens, is that at which the reaction between the reactants and the water is complete, according to a predefined completion criterion, such that the reactants are kept within the reaction chamber until the reaction is complete according to the predefined completion criterion, and wherein the predefined completion criterion at which the reaction between the reactants and the water is considered to be complete is at least one of: (i) 70% of the reaction, (ii) 80% of the reaction, (iii) 90% of the reaction, or (iv) 95% of the reaction.

2. An inflatable flotation device according to claim 1, wherein the at least one pressure sensitive passageway is further adapted to provide substantially preferential passage of the gas rather than the reactants.

3. An inflatable flotation device according to claim 1, wherein the water inlet valve is actuated by a manual actuating mechanism.

4. An inflatable flotation device according to claim 1, wherein the reaction chamber further comprises a water outlet valve, such that the reaction chamber can be emptied after use.

5. An inflatable flotation device according to claim 1, wherein the sensor is adapted to detect any one of vibration, depth, pressure or light.

6. An inflatable flotation device according to claim 1, wherein the reactants are solids.

7. An inflatable flotation device according to claim 1, wherein the at least one pressure sensitive passageway is either a semi-permeable membrane preferentially enabling passage of gases over liquids, or is sufficiently small that it allows substantially preferential passage of the gas rather than the reactants.

8. An inflatable flotation device according to claim 1, wherein at least one reactant is in a non-aqueous state.

9. An inflatable flotation device according to claim 1, wherein the reactants comprise a volume of less than 80 milliliters and generate a sufficient amount of gas for adequate inflation capabilities of the device.

10. An inflatable flotation device comprising:

an inflatable compartment;

a blister pack assembly within the inflatable compartment, the blister pack assembly comprising a first set of volumes comprising a first reactant and at least a second volume comprising a second reactant, the reactants selected to generate a volume of gas when mixed, and the first set of volumes being separated from the at least second volume by at least one separation layer;

wherein, the at least one separation layer is adapted to be removed to enable a reaction to occur between the first and second reactants, such that the gas inflates the inflatable compartment.

11. An inflatable flotation device according to claim 10 further comprising an inner reaction chamber containing the blister pack assembly within the inflatable compartment, such that the reaction chamber is fluidly connected to the inflatable compartment by means of at least one pressure sensitive passageway, adapted to open when the pressure of the gas in the reaction chamber exceeds a predetermined threshold.

12. An inflatable flotation device according to claim 10 further comprising a water inlet valve connecting the inner reaction chamber to an ambient water environment of the device such that the reaction chamber can be filled from the ambient water surrounding the device when the water inlet valve is open.

13. An inflatable flotation device according to claim 10, wherein the separation layer is adapted to be actuated by a manual trigger.

14. An inflatable flotation device according to claim 13, wherein the manual trigger is at least one cord attached to the separation layer.

15. An inflatable flotation device according to claim 10, further comprising a sensor indicative of immersion in water for more than a predetermined time, and providing a signal to activate the inflation device.

16. An inflatable flotation device according to claim 10, wherein the first set of volumes comprises a first plurality of blisters of the blister pack and the at least second volume comprises a second plurality of blisters of the blister pack, such that when the at least one separation layer is removed, the reactants mix.

17. An inflatable flotation device comprising:

a reaction chamber comprising reactants that generate gas when mixed, the reactants being separated by a barrier sheet;

a pointed element adapted to puncture the barrier sheet such that the reactants mix; and at least one pressure sensitive element adapted to open when the pressure of the gas in the reaction chamber exceeds a predetermined threshold, the pressure sensitive element being disposed between the reaction chamber and a flotation compartment inflatable by the gas.

* * * * *